US005496111A

United States Patent [19]

LaVerne

[11] Patent Number: 5,496,111

[45] Date of Patent: Mar. 5, 1996

[54] SOIL MIXING AND PUMPING TRUCK SYSTEM

[76] Inventor: Louis LaVerne, 6700 Coolidge St., Groves, Tex. 77619

[21] Appl. No.: 258,547

[22] Filed: Jun. 10, 1994

[51] Int. Cl.[6] ..... B01F 7/00

[52] U.S. Cl. ..... 366/297; 366/51; 239/172

[58] Field of Search ..... 37/466, 317, 320; 296/37.6; 280/837, 838; 366/297, 298, 299, 184, 190, 51, 603; 405/233, 240, 241, 266, 267, 128; 239/175, 172

[56] References Cited

U.S. PATENT DOCUMENTS

| | | | |
|---|---|---|---|
| 618,955 | 2/1899 | Gahagan | 37/317 X |
| 3,790,138 | 2/1974 | Neier | 366/603 X |
| 3,804,377 | 4/1974 | Kugle et al. | 366/603 X |
| 4,140,349 | 2/1979 | Behnken | 239/172 X |
| 4,147,331 | 4/1979 | Kopecky | 366/51 |
| 4,447,158 | 5/1984 | Simon | 366/297 |
| 4,712,922 | 12/1987 | Feterl | 366/603 X |
| 4,911,330 | 3/1990 | Vlaanderen et al. | 280/838 X |
| 5,005,980 | 4/1991 | Zimmerman | 366/297 X |
| 5,361,711 | 11/1994 | Bexerl | 239/172 X |

*Primary Examiner*—Ramon S. Britts
*Assistant Examiner*—Frederick L. Lagman

[57] ABSTRACT

A soil mixing and pumping truck system comprising a support region for a truck having a cab at the forward end; a chamber for the receipt of soil to be dispensed located on the support region, the chamber including a bottom wall, side walls and tapering intermediate walls therebetween, the chamber having an aperture extending downwardly therefrom with a conduit to a mud pump, the chamber having three linearly extending rods rotatable on bearing members, each rod having plural sets of blades for churning soil thereadjacent; drives for rotating the rods and blades in a common direction, the drives include a motor, transmission and drive box with associated chains between the drive box and the shafts for the rotation thereof during the pumping of the soil from the container; a mud pump located on the support region rearwardly of the chamber and coupled at an input end to the conduit from the chamber with a hose at an outlet end for the dispensing of soil from the container; a water pump located on the support region rearwardly of the container with a hose at the inlet for sucking extraneous water from the area to receive soil and a hose at the outlet for feeding such water from the hose to remote locations.

3 Claims, 4 Drawing Sheets

FIG 1
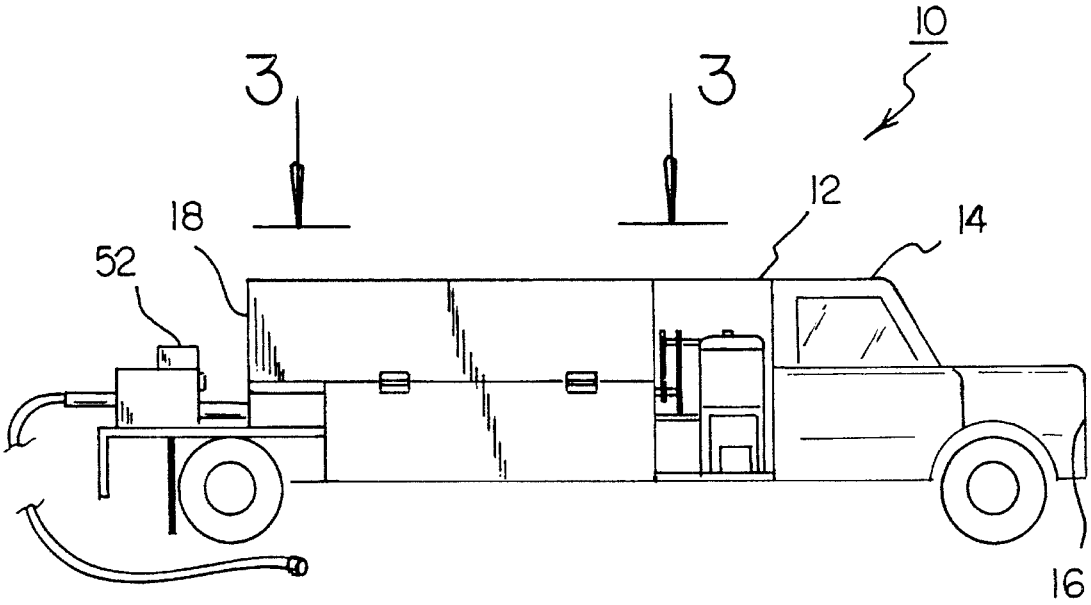
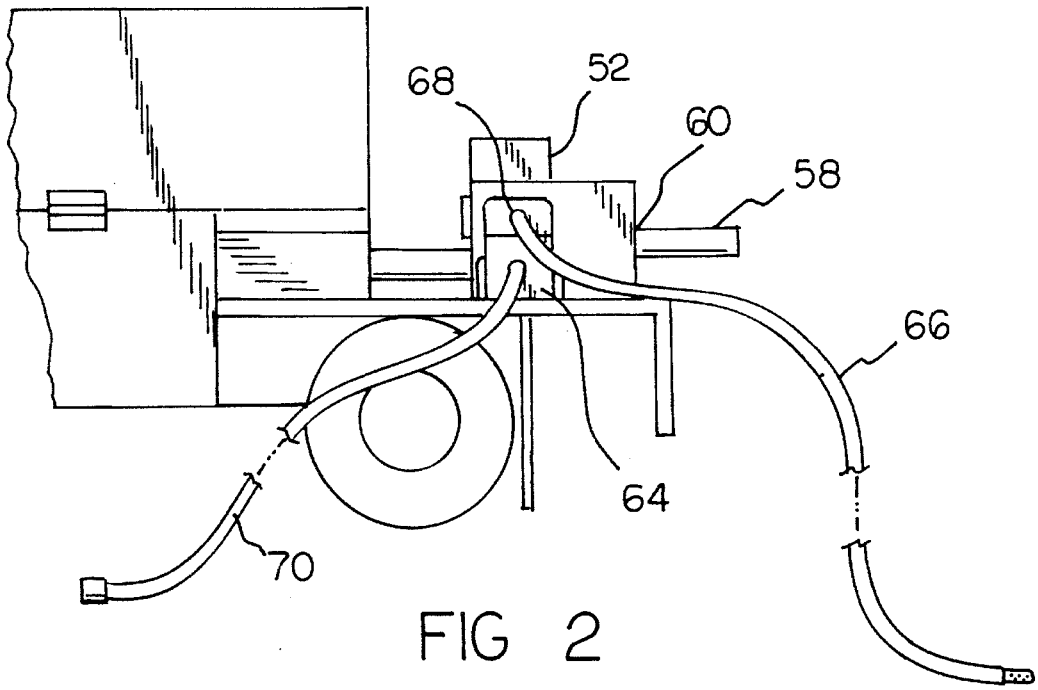
FIG 2

FIG 4
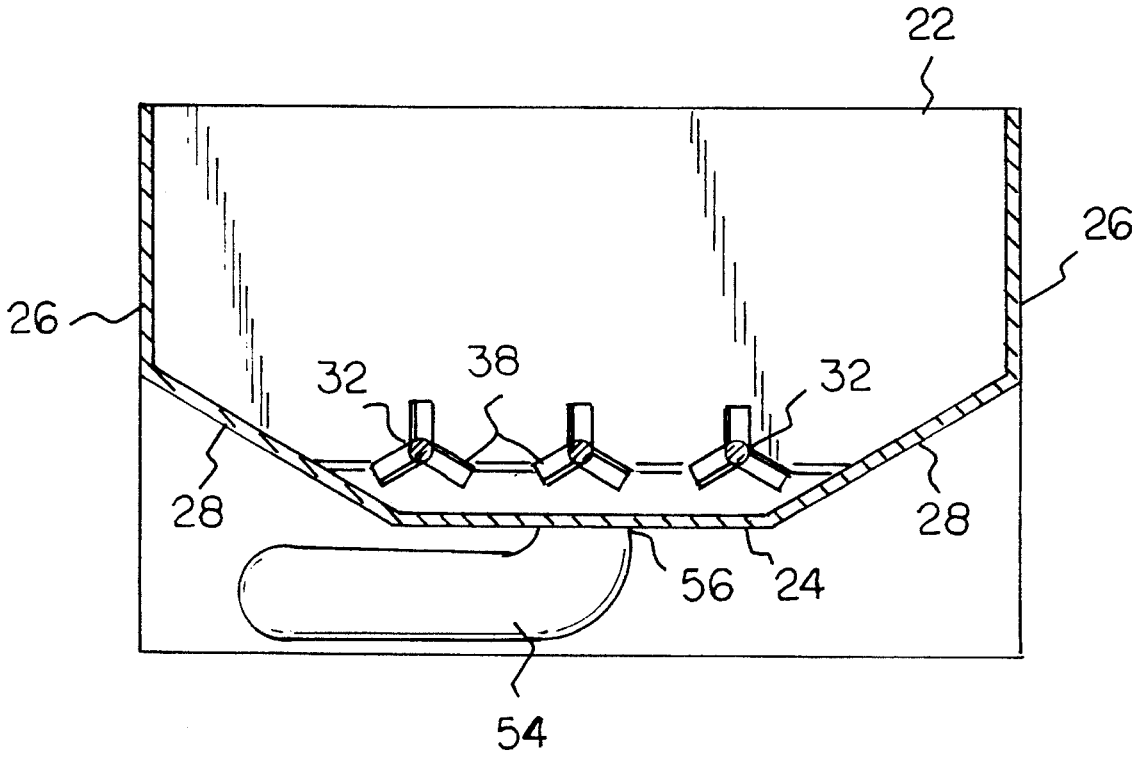
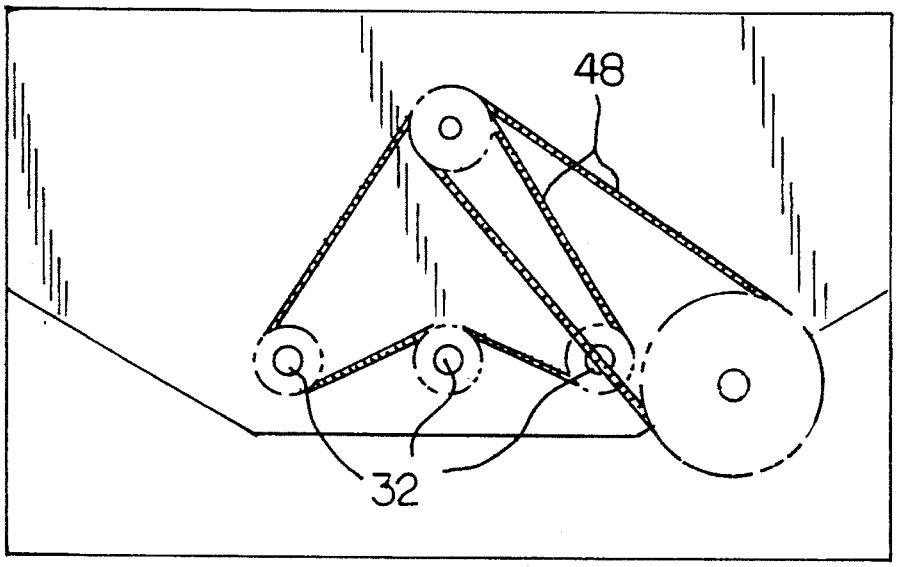
FIG 5

SOIL MIXING AND PUMPING TRUCK SYSTEM

BACKGROUND OF THE INVENTION

1. Field of the Invention

The present invention relates to a soil mixing and pumping truck system and more particularly pertains to mixing and pumping soil through a hose from a truck at a remote location.

2. Description of the Prior Art

The use of utility trucks and pumping mechanisms is known in the prior art. More specifically, utility trucks and pumping mechanisms heretofore devised and utilized for the purpose of providing various functions from a truck are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 5,096,333 to Bassett discloses a foundation repair method and apparatus.

U.S. Pat. No. 4,676,724 to Birdwell discloses a mud pump.

U.S. Pat. No. 4,541,779 to Birdwell discloses a mud pump.

U.S. Pat. No. 4,242,057 to Bender discloses a tandem long stroke reciprocating mud pump assembly.

U.S. Pat. No. 3,687,575 to Bauer discloses a conveyor worm for conveying liquids and mud-like substances.

In this respect, the soil mixing and pumping truck system according to the present invention substantially departs from the conventional concepts and designs of the prior art, and in so doing provides an apparatus primarily developed for the purpose of mixing and pumping soil through a hose from a truck at a remote location.

Therefore, it can be appreciated that there exists a continuing need for new and improved soil mixing and pumping truck system which can be used for mixing and pumping soil through a hose from a truck at a remote location. In this regard, the present invention substantially fulfills this need.

SUMMARY OF THE INVENTION

In view of the foregoing disadvantages inherent in the known types of utility trucks and pumping mechanisms now present in the prior art, the present invention provides an improved soil mixing and pumping truck system. As such, the general purpose of the present invention, which will be described subsequently in greater detail, is to provide a new and improved soil mixing and pumping truck system apparatus and method which has all the advantages of the prior art and none of the disadvantages.

To attain this, the present invention essentially comprises a new and improved soil mixing and pumping truck system comprising, in combination a truck having a cab at the forward section 16 and a support region therebehind; a chamber 12 for the receipt of soil to be dispensed located on the support region, the chamber including a bottom wall, side walls and tapering intermediate walls therebetween, the chamber having an aperture extending downwardly therefrom with a conduit to a mud pump, the chamber having three linearly extending rods rotatable on bearing members, each rod having plural sets of blades for churning soil thereadjacent; drives for rotating the rods and blades in a common direction, the drives include a motor, transmission and drive box with associated chains between the drive box and the shafts for the rotation thereof during the pumping of the soil from the container; a mud pump located on the support region rearwardly of the chamber and coupled at an input end to the conduit from the chamber with a hose at an outlet end for the dispensing of soil from the container; a water pump located on the support region rearwardly of the container with a hose at the inlet for sucking extraneous water from the area to receive soil and a hose at the outlet for feeding such water from the hose to remote locations; and a storage box located beneath the container on at least one side thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved soil mixing and pumping truck system which has all the advantages of the prior art utility trucks and pumping mechanisms and none of the disadvantages.

It is another object of the present invention to provide a new and improved soil mixing and pumping truck system which may be easily and efficiently manufactured and marketed.

It is a further object of the present invention to provide a new and improved soil mixing and pumping truck system which is of a durable and reliable construction.

An even further object of the present invention is to provide a new and improved soil mixing and pumping truck system which is susceptible of a low cost of manufacture with regard to both materials and labor, and which accordingly is then susceptible of low prices of sale to the consuming public, thereby making such utility trucks and pumping mechanisms economically available to the buying public.

Still yet another object of the present invention is to provide a new and improved soil mixing and pumping truck system which provides in the apparatuses and methods of the prior art some of the advantages thereof, while simultaneously overcoming some of the disadvantages normally associated therewith.

Still another object of the present invention is to mix and pump soil through a hose from a truck at a remote location Lastly, it is an object of the present invention to provide new and improved a soil mixing and pumping truck system comprising a support region for a truck having a cab at the forward end; a chamber for the receipt of soil to be dispensed located on the support region, the chamber including a bottom wall, side walls and tapering intermediate walls therebetween, the chamber having an aperture with a conduit to a mud pump, the chamber having three rods rotatable on bearing members, each rod having plural sets of blades for churning soil thereadjacent; drives for rotating the rods and blades in a common direction, the drives include a motor, transmission and drive box with associated chains between the drive box and the shafts for the rotation thereof during the pumping of the soil from the container; a mud pump located on the support region rearwardly of the chamber and coupled at an input end to the conduit from the chamber with a hose at an outlet end for the dispensing of soil from the container; a water pump located on the support region rearwardly of the container with a hose at the inlet for sucking extraneous water from the area to receive soil and a hose at the outlet for feeding such water from the hose to remote locations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the preferred embodiment of the new and improved soil mixing and pumping truck system constructed in accordance with the principals of the present invention.

FIG. 2 is an enlarged side elevational view of the rear portion of the truck system shown in FIG. 1 but viewed from the opposite side.

FIG. 4 is a cross-sectional view of a portion of the truck taken along line 4—4 of FIG. 3.

FIG. 5 is a cross-sectional view of the truck taken along line 5—5 of FIG. 3.

DESCRIPTION OF THE PREFERRED EMBODIMENT

Figure 3:
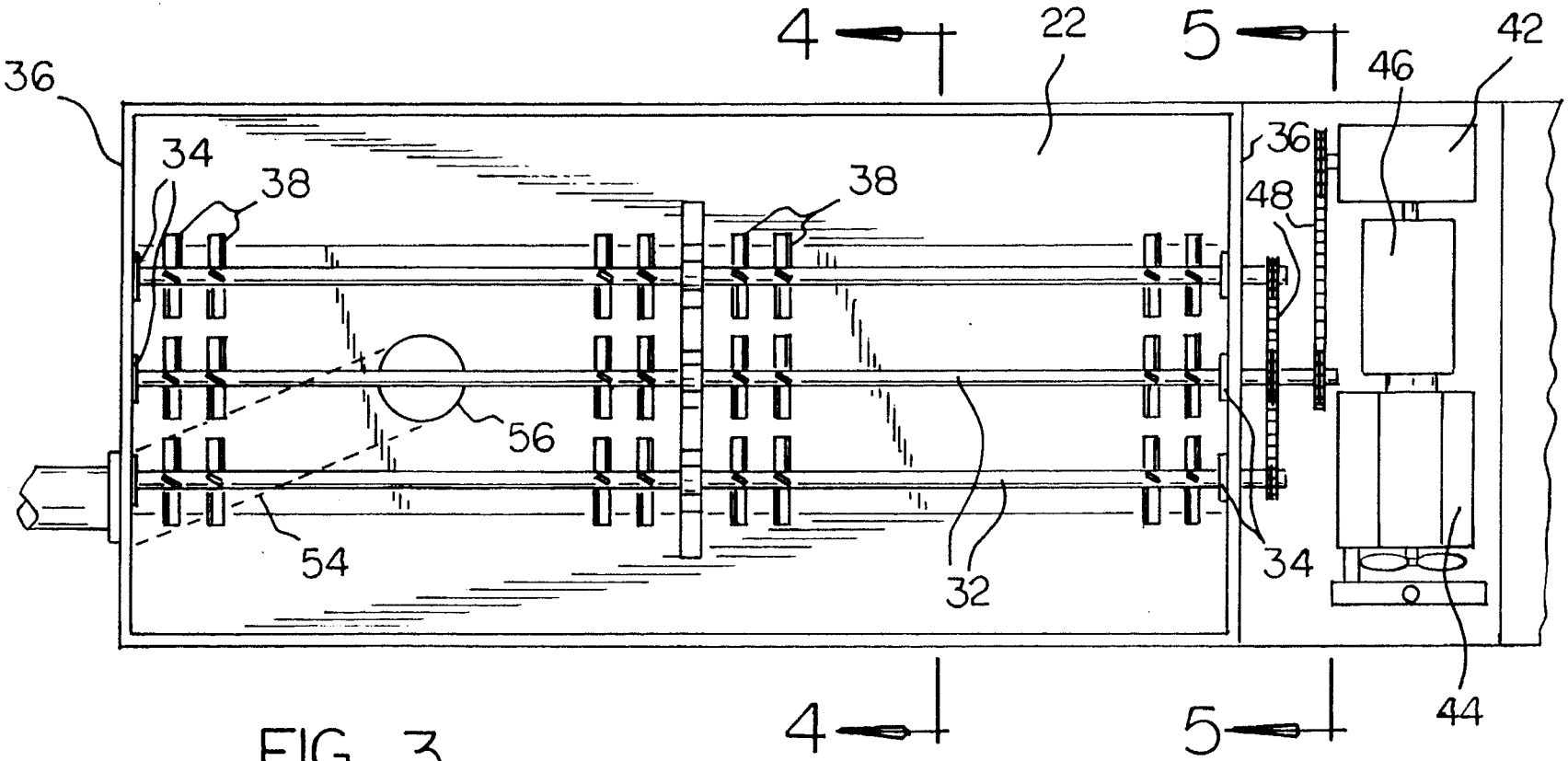
FIG. 3 is a top elevational view of the truck of FIG. 1 taken along line 3—3 of FIG. 1.
Figure 6:
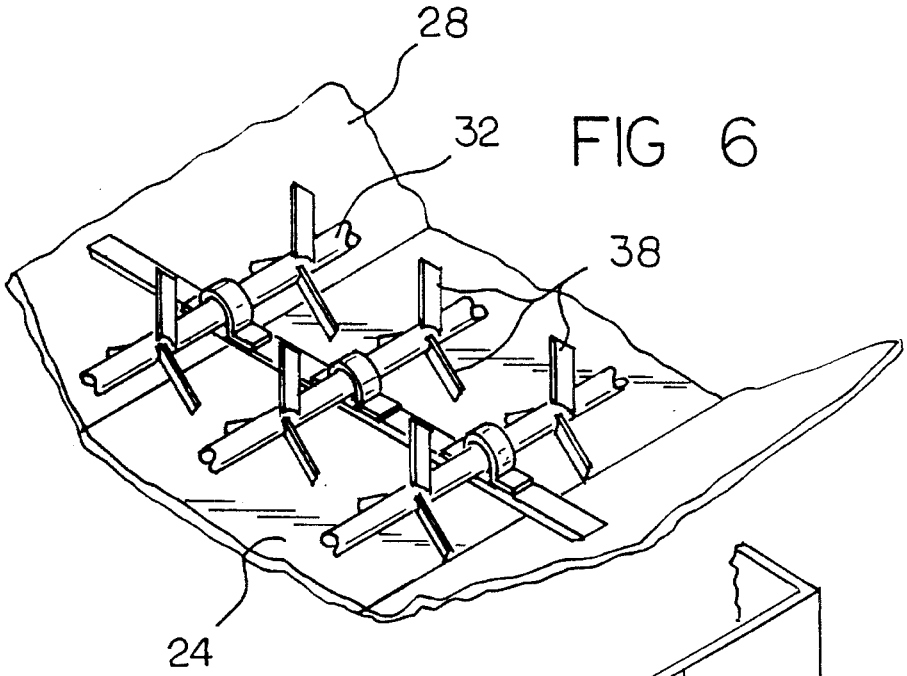
FIG. 6 is a perspective illustration of the central bites in the truck.
Figure 7:
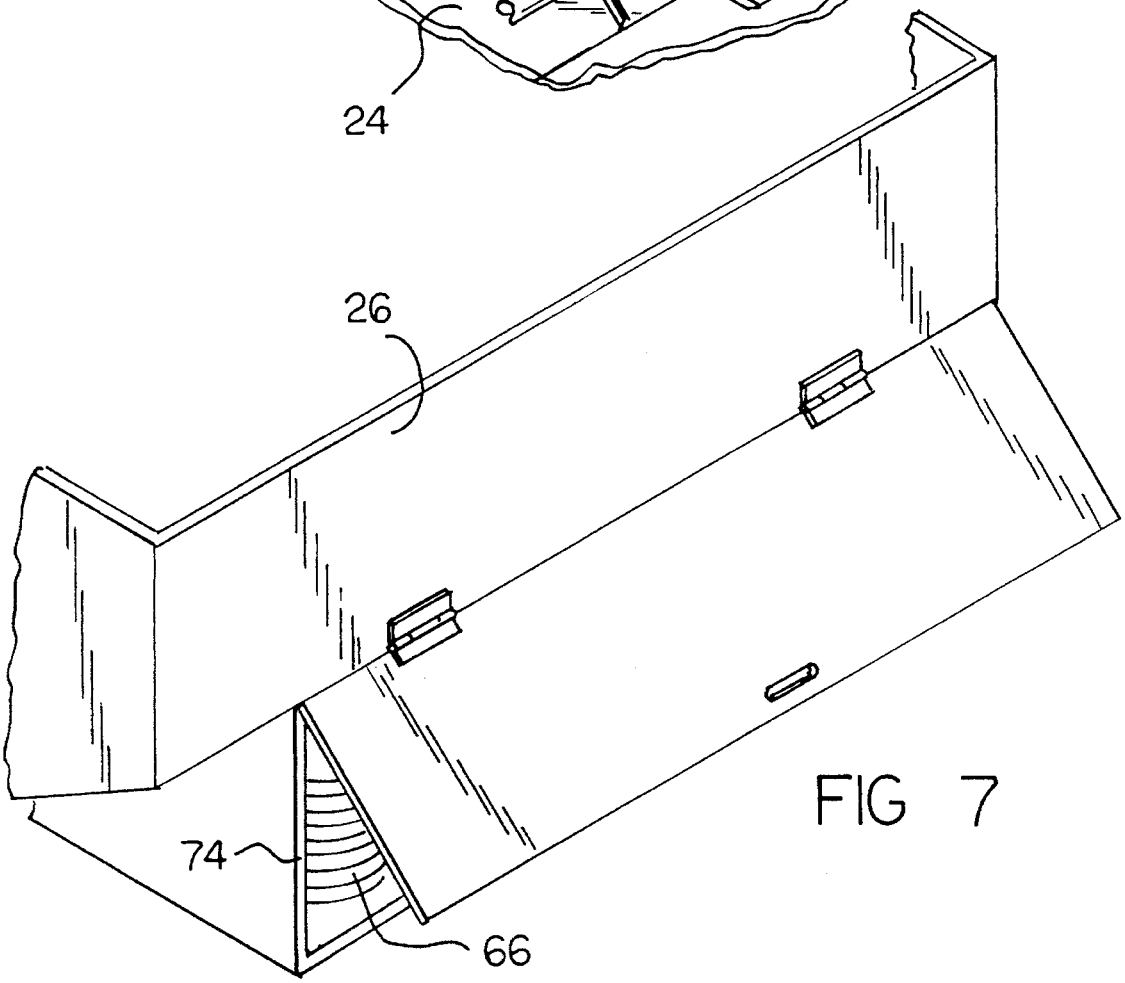
FIG. 7 is a side elevational view of the side of the truck including the storage chamber in an open condition showing the hose, The same reference numerals refer to the same parts throughout the various figures.

With reference now to the drawings, and in particular to FIG. 1 thereof, a new and improved soil mixing and pumping truck system embodying the principles and concepts of the present invention and generally designated by the reference numeral 10 will be described.

Specifically, the present invention, the new and improved soil mixing and pumping truck system is comprised of a plurality of components. Such components include a truck, a chamber, drives, a mud pump, a water pump and a storage box. Such components are individually configured and correlated with respect to each other so as to attain the desired objectives.

More specifically, the present invention is a system 10 which is mountable on a truck 12. The truck has a cab 14 at the forward section 16 and a support region 18 behind the cab.

Next provided is a chamber 22 for the receipt of soil to be dispensed from the chamber. The chamber is located on the support region. The chamber includes a bottom wall 24, side wall 26, and tapering intermediate walls 28 therebetween. The chamber has an aperture extending downwardly therefrom along the entire axial length of the chamber. The chamber extends to a mud pump as will be later described.

Located within the chamber are a plurality, preferably three, linearly extending rods 32. The rods are rotatable within bearings 34 located in the forward and rearward walls 36 of the chamber. Each rod extends beyond the rearward wall and has a shaft thereon. The shaft is positioned between the rearward wall and spaced from the cab. Each rod has plural sets of blades 38 for churning soil which is located within the chamber.

Next provided are drives 42. The drives function for rotating the rods and blades in a direction, preferably a common direction of rotation. The drives include a motor 44, a transmission 46 and a drive box. Associated chains 48 are coupled between the drive box and the shafts for the rotation thereof as is necessary during the pumping of soil from the chamber.

A mud pump 52 is next provided. The mud pump is located on the support region rearwardly of the chamber. It is coupled through a line 54 at the input end 56 of the conduit from the chamber. Included is a hose 58 at the outlet end 60 for the dispensing of soil from the chamber.

The next component of the system is a water pump 64. The water pump is located on the support region rearwardly of the chamber. The water pump has a hose 66 at the inlet 68 for sucking extraneous water from the area to receive soil. It also includes a hose 70 at the outlet for feeding such sucked water from the hose to remote locations.

Lastly provided is a storage box 74. A pair of such storage boxes are preferably provided. Each storage box is located beneath the chamber on opposite sides of the truck. The storage chamber is for providing a region for placing element associated with the present system 10 as, for example, the various hoses when not in use.

Filling in areas around the home with dirt can be an extremely tiresome chore. First, the dirt must be obtained and delivered. The ordering is usually accomplished by telephone, and the delivery by dump truck. When a dump truck enters a site, it often ruins the landscaping. After the load has been dumped, the large pile of dirt must be redistributed by hand. Clearly, if a better method for delivering the soil could be devised, then many people would benefit. That is why the present invention unit has been conceived. The present invention combines and mixes soil within its spacious tank, and then routes the soil to anywhere within a 200 foot radius.

The present invention unit is constructed from several key components three sets of rotating mining blades, a storage tank, a water pump, a mud pump powered by a separate engine, water discharge and suction hoses, a mud hose , and the necessary drive system to operate the various components. The rotating blades agitate the mud and water mixture continuously from the time it is placed in the tank at the dirt pit to the delivery location. There are three rows of vanes at the center of the tank, which is fabricated from 3/16 inch galvanized flat iron with a capacity of 4-cubic yards. The water pump is used to remove any water that may be present on the site. The water pump is used to remove any water that may be present on the site. The water is drawn into the pump through the suction hose, and is discharged through the discharge hose to a safe location. The suction hose is 30 feet long and 1 ½ inches in diameter. The discharge hose is 20 feet long and similarly constructed. The mud pump forces the mud from the tank and through the mud hose which measures 200 feet in length and 3 inches in diameter. The mud hose is fabricated in 50 foot sections that are coupled together. The drive system consists of a suitable four cylinder engine, a reduction gear box, a four speed heavy duty transmission, a drive chain, and the sprockets that connect the system parts. The present invention unit is ideally mounted to the frame of a heavy duty truck, but can be mounted to an appropriate trailer.

To use the present invention machine, any standing water present at the site must first be removed using the water pump and suction hose. Then the outlet hoses for the mud are positioned in the area to be filled. The mud pump is then activated to distribute the entire load of mud in approximately 20 minutes. In just a short period of time, measured in days, the mud will harden into solid earth that is ready for landscaping or other processing. Nothing could be easier.

The present invention eliminates having to shovel dirt from the large pile left by a dump truck. Instead, the delivered mud conforms to the ground better, and should not require compacting. Anyone who has ever used the traditional methods described is certain to appreciate the clever advantages of the present invention machine.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved soil mixing and pumping truck system comprising, in combination:

a truck having a cab at the forward section and a support region therebehind;

a chamber for the receipt of soil to be dispensed located on the support region, the chamber including a bottom wall, side walls and tapering intermediate walls therebetween, the chamber having an aperture extending downwardly therefrom with a conduit to a mud pump, the chamber having three linearly extending rods rotatable on bearing members, each rod having plural sets of blades for churning soil thereadjacent, each rod having a shaft thereon exterior the chamber and spaced from the cab;

drives for rotating the rods and blades in a common direction, the drives include a motor, transmission and drive box with associated chains between the drive box and the shafts for the rotation thereof during the pumping of the soil from the chamber;

a mud pump located on the support region rearwardly of the chamber and coupled at an input end to the conduit from the chamber with a hose at an outlet end for the dispensing of soil from the chamber;

a water pump located on the support region rearwardly of the chamber with a hose at the inlet for sucking extraneous water from the area to receive soil and a hose at the outlet for feeding such water from the hose to remote locations; and a storage box located beneath the chamber on at least one side thereof.

2. A soil mixing and pumping truck system comprising;

a support region for a truck having a cab at the forward end;

a chamber for the receipt of soil to be dispensed located on the support region, the chamber including a bottom wall, side walls and tapering intermediate walls therebetween, the chamber having an aperture extending downwardly therefrom with a conduit to a mud pump, the chamber having three linearly extending rods rotatable on bearing members, each rod having plural sets of blades for churning soil thereadjacent and a shaft spaced from the cab;

drives for rotating the rods and blades in a common direction, the drives include a motor, transmission and drive box with associated chains between the drive box and the shafts of the rods for rotation thereof during the pumping of the soil from the chamber;

a mud pump located on the support region rearwardly of the chamber and coupled at an input end to the conduit from the chamber with a hose at an outlet end for the dispensing of soil form the chamber; and a water pump located on the support region rearwardly of the chamber with a hose at the inlet for sucking extraneous water from the area to receive soil and a hose at the outlet for feeding such water from the hose to remote locations.

3. The device as set forth in claim 2 and further including:

a storage box located beneath the chamber when at least one side thereof.

* * * * *